United States Patent [19]

Foglesonger et al.

[11] Patent Number: 4,613,839

[45] Date of Patent: Sep. 23, 1986

[54] MACHINED WAVEGUIDE

[75] Inventors: John D. Foglesonger, Los Angeles; Robert A. Masters, Agoura, both of Calif.

[73] Assignee: ITT Corporation, New York, N.Y.

[21] Appl. No.: 639,160

[22] Filed: Aug. 9, 1984

[51] Int. Cl.[4] ..... H01P 3/12; H01P 5/18

[52] U.S. Cl. ..... 333/239; 29/600; 228/174; 228/196; 333/113

[58] Field of Search ..... 333/239, 245, 248, 156, 333/157, 113; 29/600; 428/586; 228/170, 174, 184, 196

[56] References Cited

U.S. PATENT DOCUMENTS

| | | | |
|---|---|---|---|
| 3,102,244 | 8/1963 | Seidel | 333/239 X |
| 3,157,847 | 11/1964 | Williams | 333/248 X |
| 3,210,695 | 10/1965 | Washecka | 333/239 |
| 3,421,116 | 1/1969 | Frank et al. | 333/248 X |
| 4,507,632 | 3/1985 | Baril et al. | 333/239 X |

OTHER PUBLICATIONS

Doughty, *Waveguide Components, A Survey of Methods of Manufacture and Inspection,* Jrnl. Brit. I.R.E., Feb. 1961, pp. 169, 175, 176.

*Primary Examiner*—Paul Gensler

*Attorney, Agent, or Firm*—T. L. Peterson; J. S. Christopher

[57] ABSTRACT

Machined planar array serpentines and transmission lines. The waveguide is fabricated in two parts. In cross section, one part is U-shaped having two side walls and a bottom wall machined out of one piece of aluminum. A plate rests upon and is arc welded to the upper edges of the side walls to provide a fourth wall.

3 Claims, 5 Drawing Figures

VERTICAL CONTROL
15
14
16
TWO COORDINATE CONTROLLER (WITH X-Y TABLE)
17

12
13
11
10
3
24
25

MACHINED WAVEGUIDE

BACKGROUND OF THE INVENTION

This invention relates to waveguide construction, and more particularly to a machined two-part waveguide.

PRIOR ART STATEMENT

The following U.S. Pat. Nos. were discovered in a search:

| U.S. Pat. No. | ISSUE DATE |
|---|---|
| 3,029,508 | April 17, 1962 |
| 3,157,847 | November 17, 1964 |
| 3,182,273 | May 4, 1965 |
| 3,505,730 | April 14, 1970 |
| 3,925,738 | December 9, 1975 |
| 4,052,683 | October 4, 1977 |

Patent '508 has a seam 13.

SUMMARY OF THE INVENTION

In accordance with the waveguide of the present invention, there is provided machined planar array serpentines and transmission lines. The waveguide is fabricated in two parts. In cross section, one part is U-shaped having two side walls and a bottom wall all machined out of one piece of metal. A plate rests upon and is arc welded to the upper edges of the side walls to provide a fourth wall.

BRIEF DESCRIPTION OF THE DRAWINGS

In the accompanying drawings which illustrate exemplary embodiments of the present invention.

DESCRIPTION OF THE PREFERRED EMBODIMENT

Figures 1, 2:
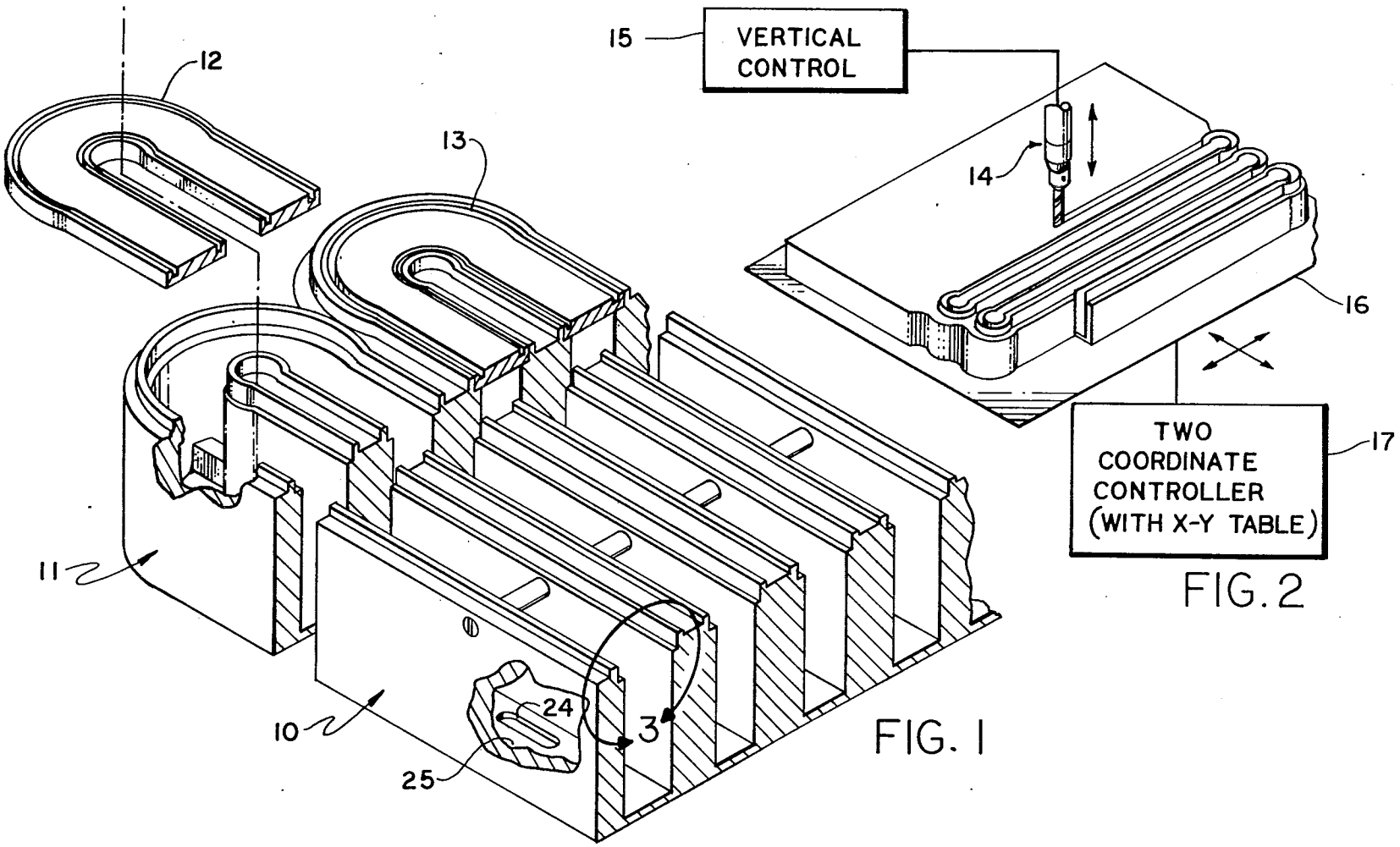
FIG. 1 is an exploded perspective view of portions of a serpentine waveguide.
FIG. 2 is a diagrammatic view of serpentines being machined.
Figure 3:
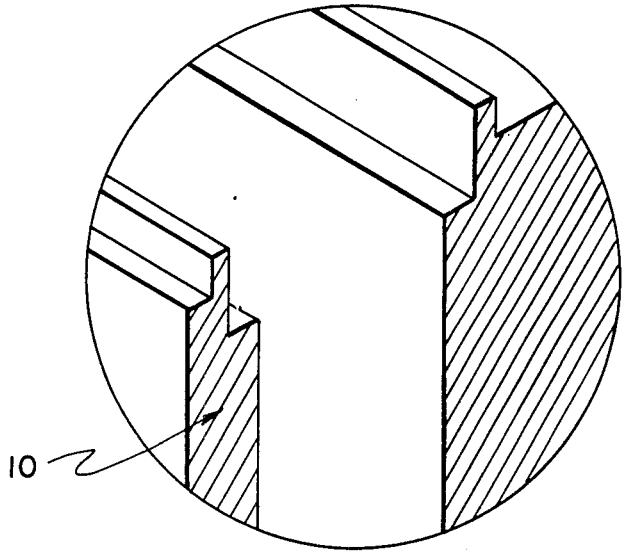
FIG. 3 is an enlarged view of the waveguide taken on the line 3—3 shown in FIG. 1.

In the drawings, in FIG. 1 end portions of serpentine waveguide are shown including a straight portion 10 and curved portions 11. Portions 10 and 11 are integral. See FIG. 2.

Figure 4:
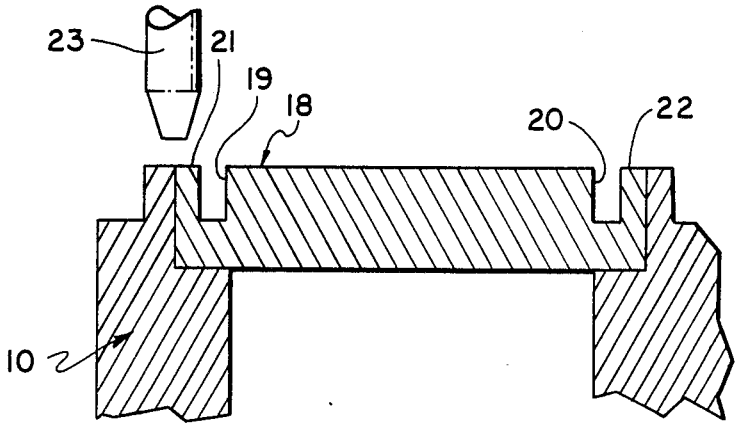
FIG. 4 is a transverse cross sectional view of the waveguide prior to welding.
Figure 5:
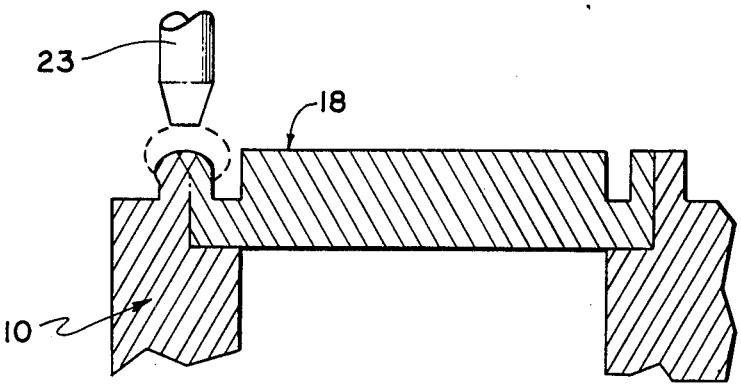
FIG. 5 is the view of FIG. 4 after welding.

In FIG. 1 the open tops of the waveguide have cover plates 12 and 13 (the ones for straight portion 10 are not shown except in FIGS. 4 and 5).

The waveguide is made on a milling machine shown in FIG. 2. The machine has a milling head 14 that is controlled vertically by a control 15. The milling is performed on a conventional x-y table 16 by a controller 17.

The cover plate for curved portions 11 is shown in FIG. 1, both before it is nested and after it is nested in notches. It should be noted that the curved portions have corresponding grooves for the same reason as straight portions, namely to leave narrow flanges to be welded to the U-shaped machined body thereby providing a gas tight space within the serpentine waveguide.

Coupling slots 24 are provided at various locations through the bottom walls or bight portions 25.

What is claimed is:

1. A machined planar waveguide comprising: a planar body machined vertically with a serpentine waveguide path of rectangular U-shaped cross section wherein said waveguide path cross section has two vertical legs and a transverse bight portion, said vertical legs having vertical notches machined on inside edges of said vertical legs and a cover plate nesting in said vertical notches, and arc welds on each side thereof to said notched body enclosing a gas tight space therewith of a rectangular cross section.

2. The invention as defined in claim 1, wherein said cover plate has a vertical groove in the outer face on each side thereof spaced close by its edges, and said vertical legs have vertical notches machined on outside edges thereof said cover and vertical legs being welded at the seam therebetween.

3. The invention as defined in claim 2, wherein a slot coupler is located in said bight portion.

* * * * *